United States Patent [19]

Müller et al.

[11] Patent Number: 4,741,463

[45] Date of Patent: May 3, 1988

[54] INGATE DEVICE AND PROCESS FOR CASTING MOLTEN METALS

[75] Inventors: Ernst Müller, Wattenheim; Hans D. Grabowski, Bochum; Hans-Joachim Böhm, Büsingen; Adolf Trautwein, Gottmadingen, all of Fed. Rep. of Germany

[73] Assignees: Chamotte- und Tonwerk Kurt Hagenburger, Gründstadt, Fed. Rep. of Germany; Georg Fischer Aktiengesellschaft, Schaffhausen, Switzerland

[21] Appl. No.: 676,242

[22] Filed: Nov. 29, 1984

[51] Int. Cl.[4] ..... B22D 43/00

[52] U.S. Cl. ..... 222/590; 222/591; 222/603; 164/134; 164/66.1; 164/58.1; 210/304; 210/519; 266/204

[58] Field of Search ..... 222/590, 591, 603, 597, 222/606; 164/134, 358, 349, 66.1, 58.1; 210/304, 519, 532.1; 266/201, 204, 232

[56] References Cited

U.S. PATENT DOCUMENTS

| | | | |
|---|---|---|---|
| 889,723 | 6/1908 | Schwickart | 164/134 |
| 3,892,272 | 7/1975 | Troy et al. | 164/134 |
| 4,290,589 | 2/1981 | Luhrsen et al. | 222/606 X |
| 4,498,661 | 2/1985 | Kobzar | 222/606 X |

FOREIGN PATENT DOCUMENTS

| | | | |
|---|---|---|---|
| 0078611 | 5/1983 | European Pat. Off. | 164/58.1 |
| 2159964 | 7/1972 | Fed. Rep. of Germany . | |
| 2215273 | 10/1973 | Fed. Rep. of Germany . | |
| 2514492 | 10/1976 | Fed. Rep. of Germany . | |
| 2720352 | 11/1977 | Fed. Rep. of Germany | 164/66.1 |
| 2708135 | 8/1978 | Fed. Rep. of Germany | 210/304 |
| 2830811 | 1/1980 | Fed. Rep. of Germany . | |
| 2950393 | 6/1981 | Fed. Rep. of Germany . | |
| 80/00546 | 4/1980 | PCT Int'l Appl. | 222/597 |
| 0428393 | 1/1967 | Switzerland | 164/358 |
| 0480487 | 6/1976 | U.S.S.R. | 164/134 |
| 0558746 | 5/1977 | U.S.S.R. | 164/134 |
| 0622558 | 9/1978 | U.S.S.R. | 164/358 |
| 0776739 | 11/1980 | U.S.S.R. | 164/58.1 |
| 0967668 | 10/1982 | U.S.S.R. | 164/58.1 |

*Primary Examiner*—Joseph J. Rolla
*Assistant Examiner*—Nils E. Pedersen
*Attorney, Agent, or Firm*—Spencer & Frank

[57] ABSTRACT

A compact and re-usable ingate device for transferring molten metal to a mold during casting employs a substantially unitary structure resembling a trapezoidal block of refractory material. Within the block are a generally cylindrical rotation chamber, an inlet channel which receives the molten metal and injects it tangentially into the rotation chamber, so that the metal swirls rapidly to separate nonmetallic inclusions, and an outlet channel which conveys the cleaned metal to the mold. The rotation chamber may have a bottom that is positioned below the opening to the outlet channel and walls which slope outward slightly from the bottom to at least the opening, so that inclusions and metal that has solidified at the bottom can be removed from the rotation chamber. Alternately the outlet channel may open into the bottom at an eccentric position, so that all of the molten metal will be drained.

18 Claims, 5 Drawing Sheets

16
17
8
14
1
2
7
6
H
4
9
18
5
10
19
15

INGATE DEVICE AND PROCESS FOR CASTING MOLTEN METALS

BACKGROUND OF THE INVENTION

The invention relates to an inlet gate or ingate device for casting molten metal, and more particularly to an ingate device having an inlet channel for receiving molten metal, an outlet channel for conveying the molten metal to a mold, and a rotation chamber connecting the inlet and outlet channels to separate nonmetallic materials from the molten metal, as well as to a process for casting molten metal using an ingate device.

The increasing demands to improve the purity of castings and to decrease the manufacturing costs by reducing the cleaning and secondary treatment have prompted attempts to improve casting methods. Pouring techniques have been improved by providing pouring basins with dividing walls and/or constrictions to absorb the slag and nonmetallic inclusions from the molten metal. Furthermore so-called whirlgate dirt traps and whirl-runners or rotary chambers are known.

German Patent specification No. 2,159,964 describes such a whirl-runner, which is used primarily for high-alloyed steel casting for reactor parts, pumps, turbine casings, etc. This well-known whirl-runner employs a rotation chamber consisting of at least three elements shifted on top of each other, each composed of parts independently exchangeable with the other elements. This whirl-runner can be used only once.

Furthermore German Offenlegungsschrift No. 2,950,393 describes a separator which is made of gasifiable plastic, embedded in the casting mold. This separator can also only be used once. Furthermore it has the disadvantage—because its wall essentially consists of rammed molding sand—that it is very susceptible to erosion and thus can become the source of nonmetallic inclusions.

SUMMARY OF THE INVENTION

It is an object of the present invention to provide an ingate device for casting molten metal and for obtaining the best separation of nonmetallic inclusions, the ingate device being re-usable several times and permitting substantially higher profitability.

The ingate device of the present invention can be employed not only for the casting of quality steels, but also for casting simple alloyed steels, gray and spheroidal graphite iron, and non-ferrous metals which would not be economically susceptible to quality improvements by other techniques. Furthermore it is an object of the invention to improve and facilitate the pouring of molten metal while simultaneously separating nonmetallic inclusions.

These and other objects can be attained by providing an ingate device which employs erosion-resistant refractory materials to provide a compact and unitary structure that is re-usable and can be positioned at a casting device, such as a mold that receives the molten metal, with the rotation chamber and outlet channel to the casting device being configured so that either the entire melt can be discharged from the rotation chamber to the casting device via the outlet channel, or the molten metal remaining in the ingate device can be removed from the rotation chamber after it solidifies.

Since the ingate device of the present invention is a compact structure which can be placed on or at the feeding system of the mold, it can be used repeatedly if erosion resistant materials and refractories are used to fabricate it.

The outlet channel of the ingate device is downwardly inclined. This, plus the fact that in a preferred embodiment metal solidified in the rotation chamber can be removed, means that consistency can be achieved when a series of castings are made by ensuring that, during each use of the ingate device, no metal has been left from the previous use.

The rotation chamber has an outwardly form with a rounded shoulder between the bottom and the peripheral wall to facilitate removal of solidified metal.

The rotation chamber has a bottom basin, as small as possible, which permits a notable reduction of the remaining solidified metal with respect to a known whirl-runner, thereby substantially improving profitability when molten metal is poured. The basin is the region between the bottom of the rotation chamber and the lower edge of the opening to the outlet channel, and has a height of up to 50%, but preferably between 5% and 20%, of the total height of the rotation chamber.

The efficiency per casting is notably improved when the ingate device of the present invention is employed, and a higher production rate which results in energy savings is achieved. The ingate device of the invention has no joints that can be eroded or through which liquid metal may pass. Thus the possibility that the whirl-runner itself may become a source for nonmetallic inclusions is totally avoided.

In a preferred embodiment the opening from the rotation chamber to the outlet channel is horizontally elongated, and the molten metal leaves the rotation chamber in a radial direction. The horizontal length of this opening is greater than its vertical height, and thus an almost loss-free radial outflow of the molten metal is reached.

According to another embodiment, however, it will not influence the separation effect of the rotation chamber at all if the molten metal leaves the rotation chamber by a circular outlet in the bottom. Such an outlet is preferably positioned not at the center of the bottom, but eccentrically.

Following a particularly preferred embodiment, the opening from the inlet channel to the rotation chamber is vertically elongated, and the molten metal flows in a tangential direction into the rotation chamber. Due to the fact that the liquid metal from the inlet channel flows tangentially into the rotation chamber, it is set into rotation. The vertical height of this opening is greater than its horizontal width.

It is advantageous in one embodiment to arrange the rotation chamber and inlet and outlet channels in a triangular configuration, when the ingate device is viewed from above, in order to achieve a compact trapezoidal design which saves material. The compact reusable structure is made of thermal shock and erosion resistant refractories, like fire-clay of high density, tabular alumina, sintered mullite, corundum, etc.

In a preferred embodiment of the invention a feeding device is added for injecting an inert flushing gas to permit the gas flushing of the liquid metal rotating in the rotation chamber. Such flushing immediately removes the oxygen introduced during the feeding of the ingate device, thus avoiding a primary source of nonmetallic inclusions.

Furthermore the flushing of the swirling metal in the rotation chamber with an inert gas, especially argon, increases the separation of already existing, nonmetallic inclusions (macroscopic and, above all, microscopic) in an unexpected way. Moreover, the flushing device permits flushing of the complete mold with an inert gas, before casting is started, so that the oxygen partial pressure in the mold is decisively reduced. The feeding device for the flushing gas is preferably placed at the bottom of the rotation chamber. A gas permeable bottom element such as a gas flushing brick may be employed.

In a preferred embodiment of the invention, the ingate device has an addition chamber for inoculants. Accordingly, inoculants such as magnesium (Mg) and/or silicon (Si) can be added to the molten metal during the pouring. Since the addition of the inoculant is effected in a rotating stream, the dispersion is improved and a better and more economical alloy is achieved.

The addition chamber, which may be a container and/or an opening for the filling or feeding of the inoculants, is preferably placed diametrically opposite the opening from the rotation chamber to the outlet channel. The inoculant metal can either be put into this container or chamber before effecting the pouring process, or it may be fed continuously through this opening in the form of a wire or granular material. This feeding of the inoculant metal into the rotating metal stream thus results in an improved mixing of the inoculant metal and thus in a higher efficiency. The addition chamber is positioned so that the inoculants are added at a low point within the rotation chamber, i.e. at a place of high ferrostatic pressure, and as a result the melting losses of the inoculant metals are low; that is, the ferrostatic pressure facilitates the complete melting of the inoculant metals.

In accordance with a particularly preferred embodiment, the opening from the rotation chamber to the outlet channel is closed by a metal sheet which melts after the ingate device is filled with molten metal.

Moreover, the new ingate device has the advantage that pouring can be effected without the entrance of air, since the ingate device may be joined directly at the casting mold by a spigot-receptacle connection. Then the otherwise necessary inlet funnel to the mold, which would suck oxygen into the liquid melt, is unnecessary.

In this re-usable compact embodiment, the advantages of the known whirlgate dirt trap and pouring basin are combined and only a little space is necessary to reach optimal hydraulic streaming conditions with respect to the separation of nonmetallic inclusions. In addition, the separation of nonmetallic inclusions is improved by gas flushing.

Furthermore this re-usable compact unity permits the possibility of pouring under vacuum, if the compact device is directly connected to the casting system by a spigot and receptacle joint.

Moreover the invention relates to a process for pouring molten metal, with the options of flushing the rotating molten metal with an inert gas and/or adding an inoculant.

It is also possible to feed an inert gas into the mold even before the casting process is started, so that the oxygen partial pressure of the atmosphere in the casting mold is decisively reduced. Inert gases such as argon or nitrogen may of course also be used for flushing during the casting process. The separation of nonmetallic inclusions is thereby decisively improved, because the flushing effect in the rotary swirl tends to enlarge microscopic and macroscopic nonmetallic inclusions by coagulation, and the enlarged incursions are more effectively separated during casting by the rotating swirl. The known whirl-runner, of German Patent specification No. 2,159,964, is limited to the separation of macroscopical inclusions.

DESCRIPTION OF THE PREFERRED EMBODIMENTS

Figure 1:
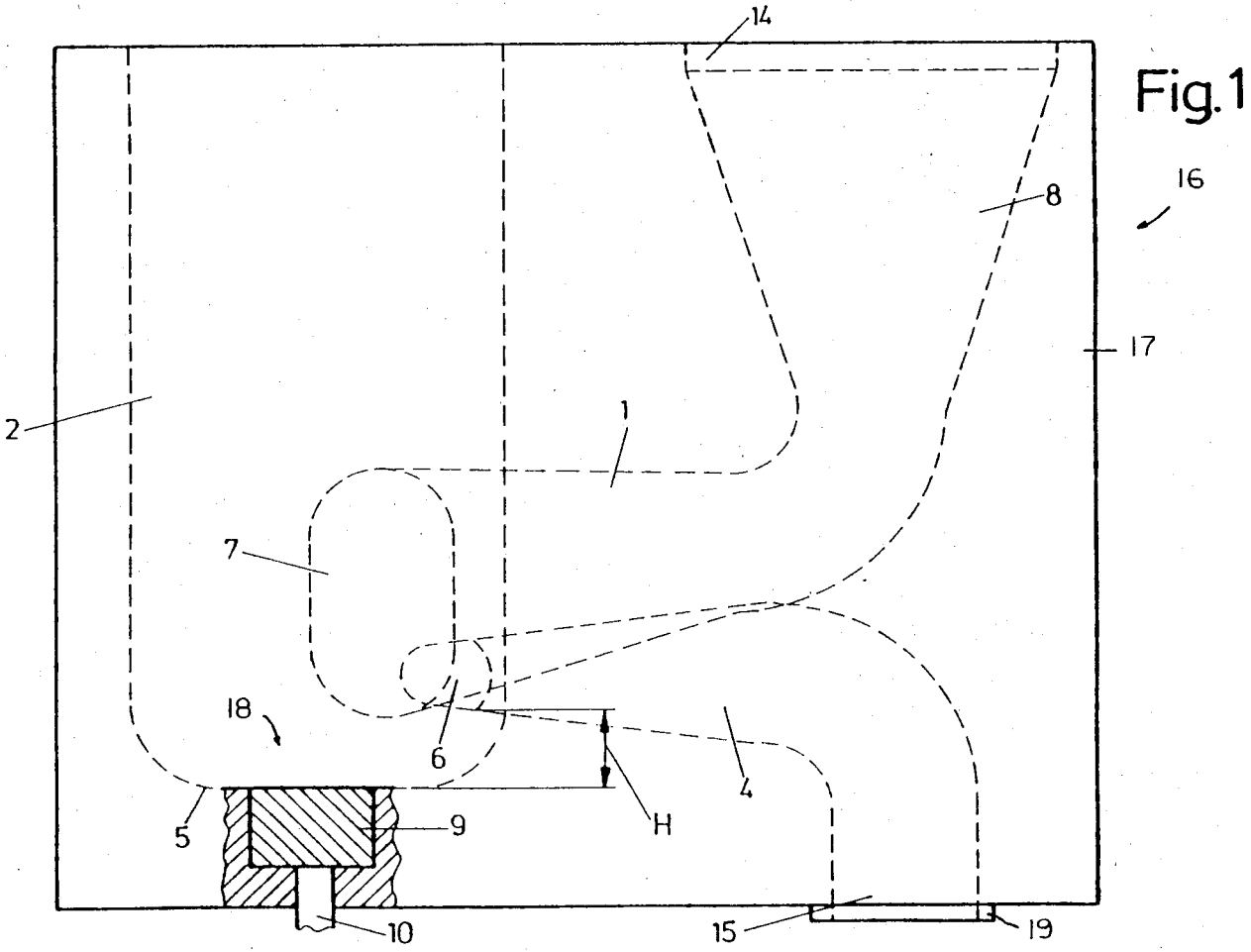
FIG. 1 is a front elevational view, (with a partial cross-sectional view) of an embodiment of the ingate device of the present invention.

With reference to FIG. 1, the ingate device 16 includes a compact and unitary structure 17 having an inlet channel 1, a rotation chamber 2, and an outlet channel 4. The rotation chamber 2 is preferably circular in crosssection and terminates in a basin portion 18 having a bottom 5. The inlet channel 1 ends with an opening 7 to the rotation chamber 2, and the outlet channel 4 is connected with the rotation chamber 2 by the opening 6. The upper part of the inlet 1 channel is constructed as a funnel 8, with a feeding opening 14. The metal melt passes the funnel 8 while streaming into the rotary chamber 2. The opening 7 is elongated in the vertical direction. The liquid metal (according to arrow 11, see FIG. 2) enters chamber 2 tangentially in order to produce a powerful swirl which, due to the resulting centrifugal force on the molten metal, concentrates the relatively light inclusions at the center of the swirl. Opening 7 is vertically elongated in order to increase the angular momentum of the molten metal entering chamber 2 by configuring the incoming metal stream so as to reduce the amount of metal that is injected close to the vertical axis of chamber 2. The opening 6 is radially disposed with respect to rotation chamber 2 and is horizontally elongated. As is indicated by arrow 12 in FIG. 2, the rotating liquid metal leaves rotation chamber 2 radially.

Figure 4:
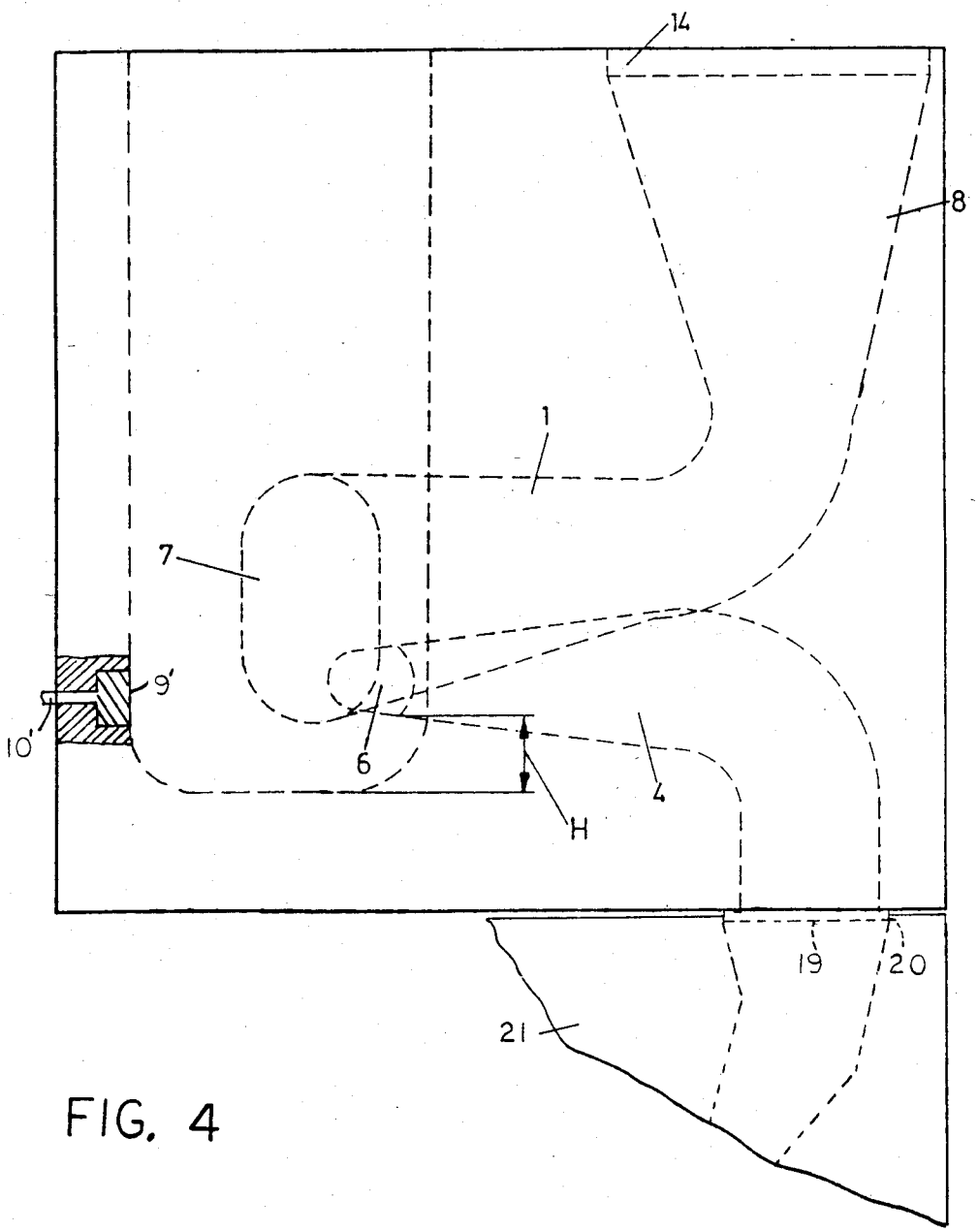
FIG. 4 is a front elevational view (with a partial cross-sectional view) of a modification of the embodiment of FIGS. 1 and 2, joined to a mold.

The outlet channel 4 conveys the molten metal to outflow opening 15, preferably directed downwardly. A flange extending from structure 17 and around opening 15 provides a spigot 19 which, when spigot 19 is inserted into the inlet recepticle 20 of a casting device such as mold 21 (see FIG. 4), joins ingate device 16 to mold 21 with a substantially air-tight seal which keeps air from the molten metal as it flows into mold 21. It should be noted that, in FIG. 4, a small gap has been left between structure 17 and mold 21 in order to facilitate illustration; during actual use, such a gap would not be present. Channel 4 is downwardly inclined, so that no liquid metal remains in the outlet channel 4. The fact that opening 6 is horizontally elongated results in good streaming conditions and reduces the space needed for the complete device 16. The bottom edge of opening 6 is spaced a distance H from the bottom 5 of rotation chamber 2, this distance H determining the depth of basin 18. To avoid any melt remaining in the inlet channel 1, the lowest edge of the opening 7 must be positioned at the same height or higher than the lowest edge of the opening 6. The relation of width (measured horizontally) to height (measured vertically) of the opening 7 may be in the range of 1:1.5 to 1:4, and that of the opening 6 may be in the range of 1.5:1 to 4:1.

The rotation chamber 2, starting from the bottom 5 up to at least the lowest edge of the opening 6, slopes outwardly, getting larger from the bottom to the top. The slope is at least 1%; that is to say, in the outwardly sloping region the cross-sectional area of chamber 2 increases by at least 1%, in square units, for each unit rise.

The height H of the bottom basin 18 ranges from 0 to 50%—preferably 5% to 20%—of the total height of the rotation chamber 2. The passage from the bottom 5 to the circumferential wall of the rotation chamber 2 is rounded. Due to this outwardly sloping construction of the rotation chamber 2, the solidified melt remaining in the basin 24 can easily be removed via the mouth of rotation chamber 2, which guarantees the re-usability of the device 16. The removal can be accomplished by inserting a hoop into the metal in basin 18 before it solidifies and using the hoop to withdraw the metal after solidification. Alternately an electromagnet may be used to withdraw the metal after it has cooled (assuming that the metal is magnetic), or a threaded bore may be machined into the solidified metal to receive a threaded hook for manipulating the metal.

The lower edge of the opening 6 to outlet channel 4 can be positioned at the same level as bottom 5, thus avoiding the basin 18 so that a complete outflow from the rotation chamber 2 takes place.

A gas permeable element 9, such as a ceramic gas flushing brick, is present at the bottom of chamber 2. Element 9, together with a tube 10, provides a feeding device for an inert flushing gas like argon. The feeding device can also be provided in such a way that the inert gas is fed radially or tangentially into the rotation chamber, as is illustrated by gas permeable element 9' and tube 10' in FIG. 4.

Figure 2:
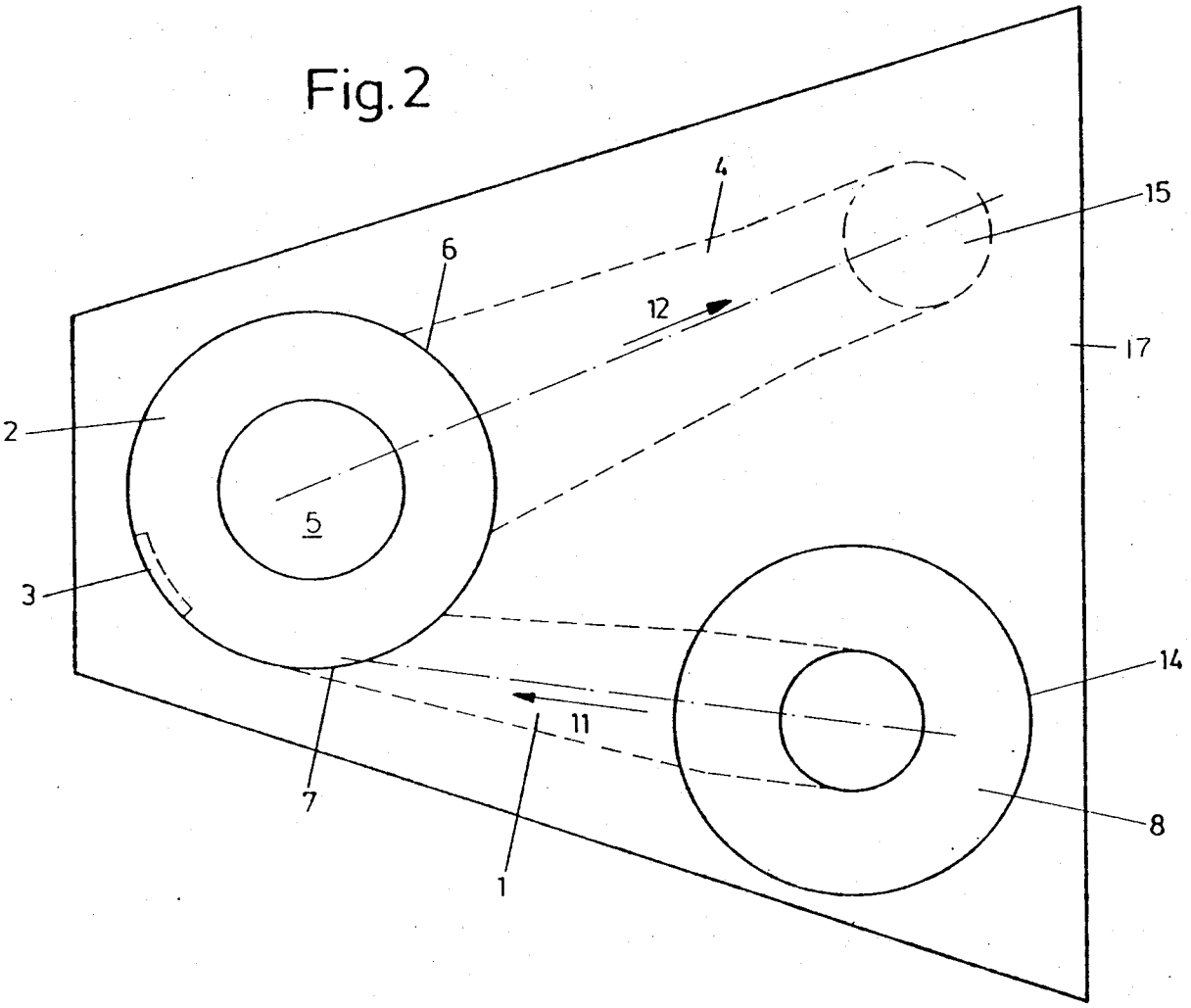
FIG. 2 is a top plan view of the ingate device illustrated in FIG. 1.

From FIG. 2, it will be apparent that the rotation chamber 2, the feeding opening 14, and the discharge opening 15 are, when seen from above, constructed in a triangular way so that the structure 17, when seen from above, is configured trapezoidally in a way that saves material.

Unitary structure 17 can be fabricated using the "lost wax" process. Elements which are made of wax and which have the forms of rotation chamber 2 and channels 1 and 4 are positioned in a trapezoidal mold, which is then packed with a refractory material such as high density fire clay, alumina, tabular alumina, chromite, corundum, and/or spinelle. Thereafter the wax elements are melted, leaving voids in the refractory material. Organic residues are removed by heating unitary structure 17 before it is used the first time.

The operation of ingate device 22 will be summarized with reference to FIG. 2. Molten metal entering via funnel 8 of inlet channel 1 passes into rotation chamber 2 through opening 7. The construction of opening 7 is such that the molten metal enters tangentially into the chamber 2, as is illustrated by arrow 11. Due to this tangential entry, the molten metal in chamber 2 rotates rapidly. An inoculant can be added to the molten metal in the rotation chamber 2 via the addition chamber 3. The addition chamber 3 is preferably diametrically opposite to the opening 6. The molten metal passes through the opening 6 in a radial direction on its way to the outlet conduit 4, as is illustrated by arrow 12 in FIG. 2.

Figure 3:
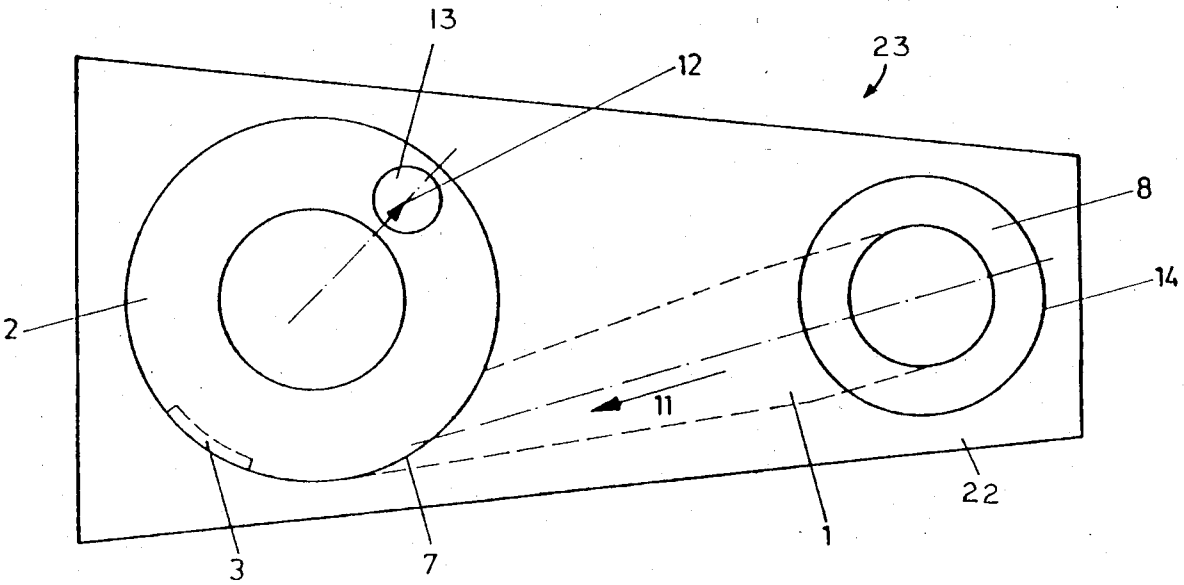
FIG. 3 is a top plan view illustrating a second embodiment of the ingate device of the present invention.
Figure 5:
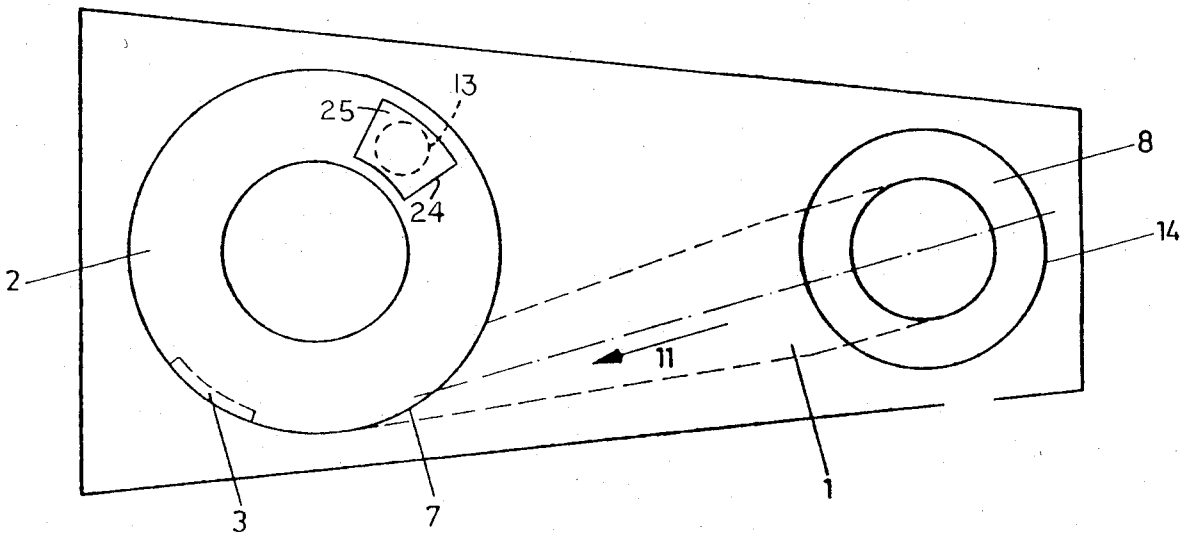
FIG. 5 is a top plan view of a modification of the embodiment of FIG. 3.

FIG. 3 illustrates a unitary structure 22 which provides an ingate device 23 in which the molten metal is discharged from chamber 2 vertically downwardly and not radially. The opening 13 from chamber 2 is then constructed eccentrically in the bottom 5. As is illustrated in FIG. 5, a recess 24 can be provided at opening 13 to accommodate a metal plate 25 which initially closes opening 13 but which melts after molten metal is fed to the ingate device. In a similar manner, a metal plate can be used to initially close the opening 6 in FIG. 1.

The ingate devices of the present invention can be used multiple times, since they are resistant to at least ten thermal shock alternations (that is, the thermal shock resulting when they receive a pouring of molten metal).

It will be understood that the above description of the present invention is susceptible to various modifications, changes, and adaptations, and the same are intended to be comprehended within the meaning and range of equivalents of the appended claims.

What is claimed is:

1. In an ingate device for transferring molten metal to a casting device, the ingate device including means defining an inlet channel for receiving the molten metal, means defining a rotation chamber in fluid communication with the inlet channel for separating nonmetallic materials from the molten metal, and means defining an outlet channel in fluid communication with the rotation chamber for conveying molten metal from the rotation chamber, the improvement wherein:

said means defining an inlet channel, means defining a rotation chamber, and means defining an outlet channel comprise a unitary structure that is compact and re-usable, said unitary structure being positionable on said casting device;

said rotation chamber has an upwardly disposed chamber opening, a bottom, and a wall between said chamber opening and bottom, said wall having an inlet opening from said inlet channel and having an outlet opening to said outlet channel, with the cross-sectional dimensions of said rotation chamber at every point above said bottom being at least as great as the cross-sectional dimensions of said rotation chamber adjacent said bottom so that metal solidified at said bottom can be withdrawn through said chamber opening;

said unitary structure additionally has a feeding opening, said inlet channel sloping continuously downward to said inlet opening in said wall of said rotation chamber so that substantially all molten metal that is poured into said feeding opening drains into said rotation chamber;

said unitary structure additionally has an outflow opening, said outlet channel sloping continuously downward from said outlet opening in said wall of said rotation chamber to said outflow opening so that substantially all molten metal that flows out of said rotation chamber drains out of said unitary structure through said outflow opening; and said outlet channel is an airtight conduit communicating between said outlet opening in said wall of said rotation chamber and said casting device.

2. The ingate device of claim 1, wherein said outlet opening has a lower edge that is spaced above said bottom by a distance of up to 50% of the height of the chamber; wherein said wall slopes outwardly from said bottom at least to the lower edge of the outlet opening; and wherein said wall is rounded adjacent said bottom.

3. The ingate device of claim 2, wherein said chamber has an axis passing through said bottom; wherein the outlet channel is radially disposed to the chamber at said outlet opening; and wherein said outlet opening is wider, in a plane perpendicular to the axis of the chamber, that it is high, in a plane running through the axis of the chamber.

4. The ingate device of claim 3, wherein said inlet opening in said wall of said rotation chamber is higher, in a plane passing through the axis of the chamber, than it is wide, in a plane perpendicular to the axis of the chamber; wherein said wall has a substantially circular cross-section in a plane perpendicular to the axis of the chamber and passing through the inlet opening; and wherein the inlet channel is tangentially disposed to the chamber at said inlet opening.

5. The ingate device of claim 3, further comprising a metal sheet closing the outlet opening, said sheet melting after the chamber is filled with molten metal.

6. The ingate device of claim 2, wherein said unitary structure has a top side and, when viewed from said top side, has a trapezoidal shape, with the rotation chamber and inlet and outlet channels being disposed in said unitary structure in a generally triangular configuration.

7. The ingate device of claim 2, wherein said unitary structure is formed of refractory material selected from the group consisting of fire clay of high density, alumina, tabular alumina, chromite, and spinelle, and is resistant to at least ten thermal shock alternations.

8. The ingate device of claim 2, further comprising means for feeding an inert flushing gas to the rotation chamber.

9. The ingate device of claim 8, wherein said means for feeding comprises a gas-permeable element positioned at the bottom of the rotation chamber.

10. The ingate device of claim 2, wherein said unitary structure also has an addition chamber to selectively contain inoculant material, said addition chamber communicating with the rotation chamber to disperse the inoculant material from the addition chamber to the molten metal in the rotation chamber.

11. The device of claim 10, wherein said addition chamber is positioned diametrically across the rotation chamber from the outlet opening.

12. The ingate device of claim 2, wherein the casting device has a recepticle for receiving molten metal from the outlet channel; and wherein the unitary structure includes a spigot disposed at said outflow opening said spigot being insertable in the recepticle to operationally join the ingate device to the casting device.

13. The ingate device of claim 2, wherein the lower edge of said outlet opening is spaced above said bottom by a distance ranging from 5% to 20% of the height of the chamber; and wherein the outward slope of the wall from said bottom at least to the lower edge of the outlet opening is greater than 1%.

14. A process for transferring molten metal to a casting device having an inlet, comprising:

joining to the casting device a compact and substantially unitary structure that is configured as an ingate device having a chamber and downwardly directed outlet channel within the substantially unitary structure by creating a substantially airtight seal between the outlet channel and the inlet of the casting device;

injecting molten metal into the chamber of the substantially unitary device;

rapidly rotating the molten metal within the substantially unitary device;

flushing the molten metal with an inert gas that is introduced into said chamber as the molten metal rotates;

discharging at least a portion of the molten metal from the chamber via the outlet channel; and removing any remaining metal from the chamber so that the ingate device can be re-used.

15. The process of claim 14, further comprising the step of flushing the ingate device with inert gas before conducting the step of injecting molten metal.

16. The process of claim 14, wherein said step of flushing the molten metal with an inert gas is conducted by introducing the gas into the chamber radially.

17. The process of claim 14, wherein said step of flushing the molten metal with an inert gas is conducted by introducing the gas into the chamber tangentially.

18. The process of claim 14, further comprising the step of adding an inoculant into the chamber as the molten metal rotates.

* * * * *